US011265636B1

(12) United States Patent
Kim

(10) Patent No.: US 11,265,636 B1
(45) Date of Patent: Mar. 1, 2022

(54) MULTIFUNCTIONAL BLUETOOTH MICROPHONE

(71) Applicant: Doors Korea Co., Ltd, Seoul (KR)

(72) Inventor: Dae Sung Kim, Seoul (KR)

(73) Assignee: DOORS KOREA CO., LTD., Seoul (KR)

( * ) Notice: Subject to any disclaimer, the term of this patent is extended or adjusted under 35 U.S.C. 154(b) by 0 days.

(21) Appl. No.: 17/034,621

(22) Filed: Sep. 28, 2020

(51) Int. Cl.

| | |
|---|---|
| ***H04R 1/08*** | (2006.01) |
| ***H04R 3/00*** | (2006.01) |
| ***F21V 23/00*** | (2015.01) |
| ***F21S 10/06*** | (2006.01) |
| ***F21V 23/06*** | (2006.01) |

(52) U.S. Cl.
CPC ..... *H04R 1/08* (2013.01); *F21S 10/063* (2013.01); *F21V 23/003* (2013.01); *F21V 23/06* (2013.01); *H04R 3/00* (2013.01); *H04R 2420/07* (2013.01)

(58) Field of Classification Search
CPC ..... H04R 1/08; H04R 3/00; H04R 2420/07; F21S 10/063; F21V 23/003; F21V 23/06; G10H 1/16; G10H 1/043; H03G 5/00
USPC ..... 381/61, 62, 91, 104, 106, 122, 124
See application file for complete search history.

(56) References Cited

U.S. PATENT DOCUMENTS

| | | | | |
|---|---|---|---|---|
| 2002/0031233 | A1* | 3/2002 | Ueshima | H04R 3/00 381/61 |
| 2015/0172808 | A1* | 6/2015 | Furuya | H04R 1/083 381/122 |
| 2018/0332387 | A1* | 11/2018 | You | H04B 1/08 |
| 2019/0159001 | A1* | 5/2019 | Wang | H04W 4/80 |
| 2021/0219039 | A1* | 7/2021 | Robateau | G10H 1/361 |

* cited by examiner

*Primary Examiner* — William A Jerez Lora
(74) *Attorney, Agent, or Firm* — Novick, Kim & Lee, PLLC

(57) ABSTRACT

A multifunctional Bluetooth microphone includes a handle having a microphone head formed at one end to receive a sound signal; a device mounting unit coupled to the handle to be adjacent to the microphone head, equipped with Bluetooth technology, and provided with a high-power speaker on one side; a digital signal processing unit provided in the device mounting unit to add an additional function of at least one type of echo mode or at least one type of voice modulation mode to a voice of a person by performing digital signal processing on the voice; a function input unit provided in the device mounting unit for operation of the digital signal processing unit; and a microphone controller for controlling operation of the digital signal processing unit on the basis of an input signal of the function input unit.

4 Claims, 10 Drawing Sheets

MULTIFUNCTIONAL BLUETOOTH MICROPHONE

BACKGROUND OF THE INVENTION

Field of the Invention

The present invention relates to a multifunctional Bluetooth microphone, and more specifically, to a multifunctional Bluetooth microphone, which can allow a user to enjoy singing more cheerfully and attract interest and curiosity of consumers as various functions such as a digital signal processor (DSP) can be mounted, in addition to conventional simple functions.

Background of the Related Art

Bluetooth means a short-range wireless technique standard for exchanging information by connecting portable devices such as cellular phones, notebook computers, earphones, headphones or the like. It is mainly used when a low-power wireless connection is required at a very short distance of around 10 meters.

For example, when a Bluetooth headset is used, it is possible to listen to music embedded in an MP3 player or a smartphone in a pocket without a cumbersome cable.

As the same concept, a Bluetooth microphone may be used when a user sends and sings a song built or stored in the device itself or built in a smartphone.

The Bluetooth microphone like this may be used for boosting excitement at a party or the like, for practicing singing alone, or for enjoying poetry recitation through calm music.

Particularly, the Bluetooth microphone is widely used when a user wants to practice singing alone at home or in a car without visiting a karaoke room. Therefore, in recent years, Bluetooth microphones manufactured in various unique designs or Bluetooth microphones having various functions are released as a product.

However, considering that most of the products are only equipped with functions as simple as to link a karaoke application even though various functions are added to the Bluetooth microphones, the functions are too trivial to raise the value as a product.

Therefore, considering that when a Bluetooth microphone can be equipped with a function such as a digital signal processor (DSP), various functions such as an echo function and the like may be added to a singing voice by performing digital signal processing on the voice of a singing person, and a user may enjoy singing more cheerfully, and therefore, the Bluetooth microphone may attract interest and curiosity of consumers, at least a need for a Bluetooth microphone to which these functions can be added is emerged.

SUMMARY OF THE INVENTION

Therefore, the present invention has been made in view of the above problems, and it is an object of the present invention to provide a multifunctional Bluetooth microphone, which can allow a user to enjoy singing more cheerfully and attract interest and curiosity of consumers as various functions such as a digital signal processor (DSP) can be mounted, in addition to conventional simple functions.

To accomplish the above object, according to one aspect of the present invention, there is provided a multifunctional Bluetooth microphone comprising: a handle having a microphone head formed at one end to receive a sound signal; a device mounting unit coupled to the handle to be adjacent to the microphone head, equipped with Bluetooth technology, and provided with a high-power speaker on one side; a digital signal processing unit provided in the device mounting unit to add an additional function of at least one type of echo mode or at least one type of voice modulation mode to a voice of a person by performing digital signal processing on the voice; a function input unit provided in the device mounting unit for operation of the digital signal processing unit; and a microphone controller for controlling operation of the digital signal processing unit on the basis of an input signal of the function input unit.

The multifunctional Bluetooth microphone may further comprise: an FM transmission function unit provided in the device mounting unit to mix a sound source transferred through Bluetooth with an input voice of a person for wireless expansion and then output the sound through a radio receiver by FM transmission, wherein the operation thereof is controlled by the microphone controller according to the input signal of the function input unit; an MR removal function unit for emphasizing the voice of the person by removing chorus and accompaniment portions (MR) from the sound source transferred through Bluetooth, wherein the operation thereof is controlled by the microphone controller according to the input signal of the function input unit; and a duet function unit for allowing, when any one multifunctional Bluetooth microphone is connected to a Bluetooth sound source in a state where two or more multifunctional Bluetooth microphones are connected through Bluetooth, all the multifunctional Bluetooth microphones to interwork and simultaneously play back the Bluetooth sound source, wherein the operation thereof is controlled by the microphone controller according to the input signal of the function input unit.

The multifunctional Bluetooth microphone may further comprise: an LED display window provided on one side of the device mounting unit to output an input value of the function input unit; an auxiliary (Aux) out terminal unit provided on the bottom of the device mounting unit for wired expansion; a multi-USB port disposed around the Aux out terminal unit and capable of charging or data communication; a memory card port provided on one side of the device mounting unit; and an earphone jack provided on one side of the device mounting unit.

The multifunctional Bluetooth microphone may further comprise a USB light emitting lamp including a terminal coupling unit detachably coupled to the multi-USB port and emitting light when music is output, wherein the microphone controller may control the operation of the USB light emitting lamp to be automatically turned on when the USB light emitting lamp is connected.

The multifunctional Bluetooth microphone may further comprise a USB light emitting rotation ball including a terminal coupling unit detachably coupled to the multi-USB port, a rotating lamp ball for emitting light while rotating, and a connection line for connecting the terminal coupling unit and the rotating lamp ball, and emitting light and rotating when music is output, wherein when the USB light emitting rotation ball is connected, the microphone controller may control the operation of the USB light emitting rotation ball to be automatically turned on.

DESCRIPTION OF SYMBOLS

Figure 1:
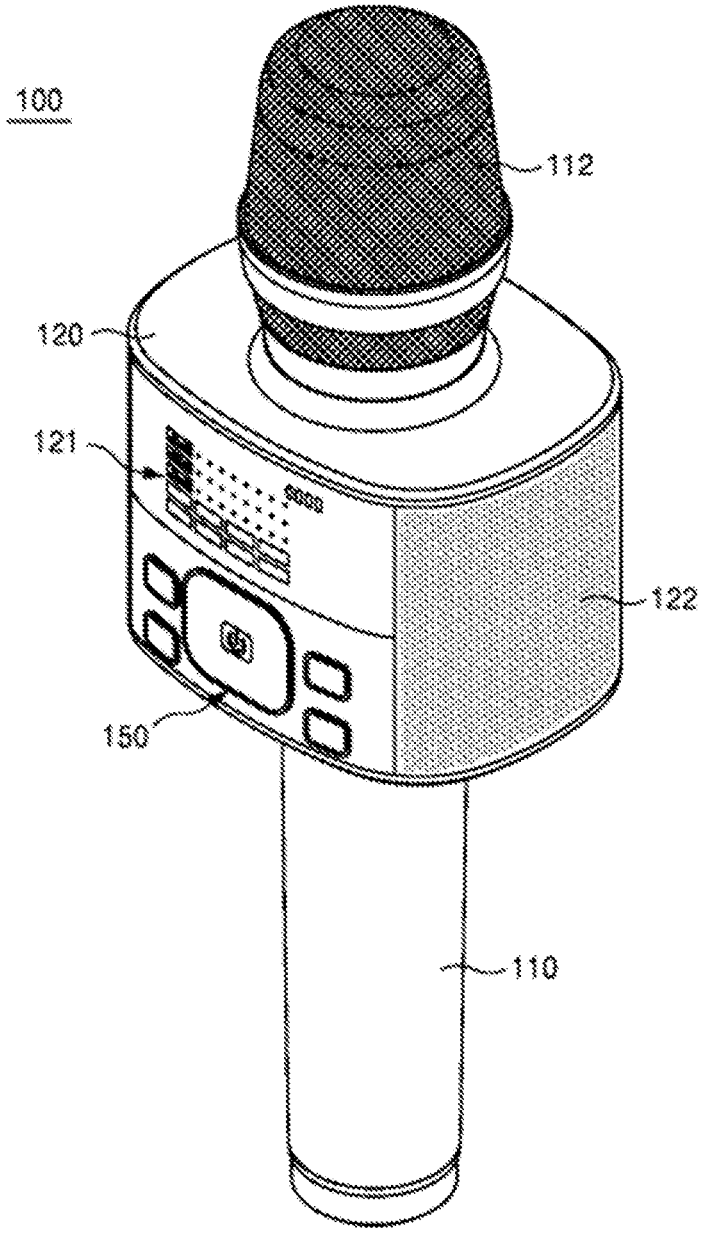
FIG. 1 is a perspective view showing a multifunctional Bluetooth microphone according to a first embodiment of to the present invention.

100: Multifunctional Bluetooth microphone
110: Handle
112: Microphone head
120: Device mounting unit
121: LED display window
122: High power speaker
131: Digital signal processing unit
132: FM transmission function unit
133: MR removal function unit
134: Duet function unit
141: Aux out terminal unit
142: Multi-USB port
143: Memory card port
144: Earphone jack
150: Function input unit
160: Microphone controller

DETAILED DESCRIPTION OF THE INVENTION

Advantages and features of the present invention, and a method of achieving them will become apparent with reference to the embodiments described below in detail together with the accompanying drawings.

However, the present invention is not limited to the embodiments disclosed below and will be implemented in various different forms.

In this specification, the present embodiment is provided to complete the disclosure of the present invention and to fully inform the scope of the present invention to those skilled in the art. In addition, the present invention is only defined by the scope of the claims.

Accordingly, in some embodiments, well-known components, well-known operations, and well-known techniques will not be described in detail to avoid obscuring interpretation of the present invention.

Like reference numerals refer to like components throughout the specification. In addition, the terms used (mentioned) in this specification are for explaining the embodiments and are not intended to limit the present invention.

In this specification, a singular form also includes plural forms unless specially mentioned in a written phrase. In addition, components and operations (actions) referred to as 'comprising (or having)' do not preclude presence or addition of one or more other components and operations.

Unless otherwise defined, all terms (including technical and scientific terms) used in this specification may be used as a meaning that can be commonly understood by those skilled in the art.

In addition, terms defined in a commonly used dictionary are not interpreted ideally or excessively unless defined.

Hereinafter, a preferred embodiment of the present invention will be described with reference to the accompanying drawings.

Figure 2:
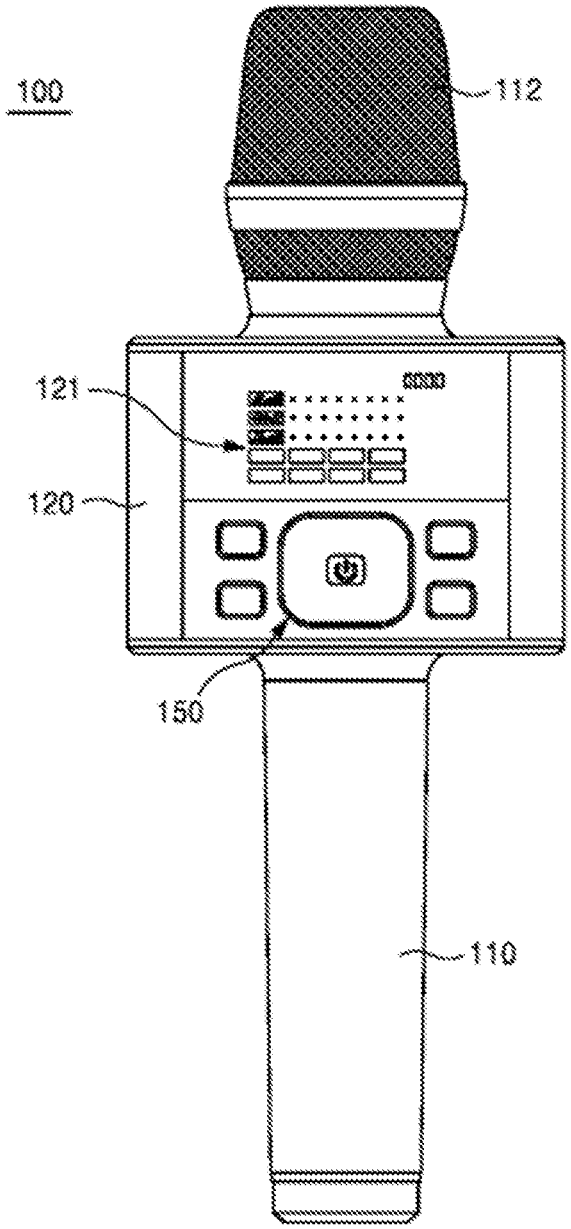
FIGS. 2 to 4 are a front view, a plan view and a bottom view of FIG. 1.
Figure 3:
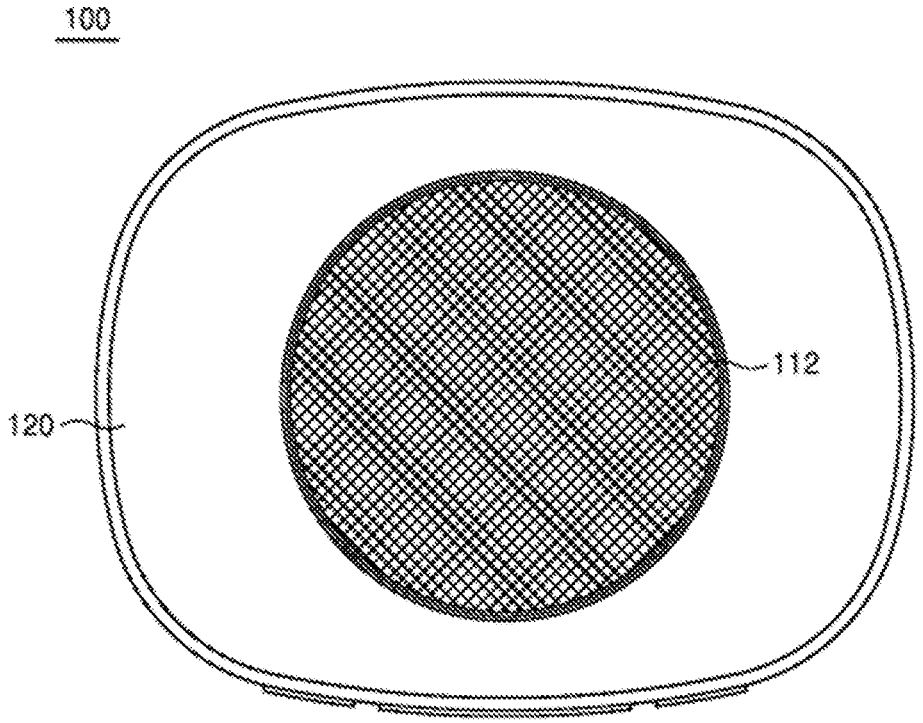
Figure 4:
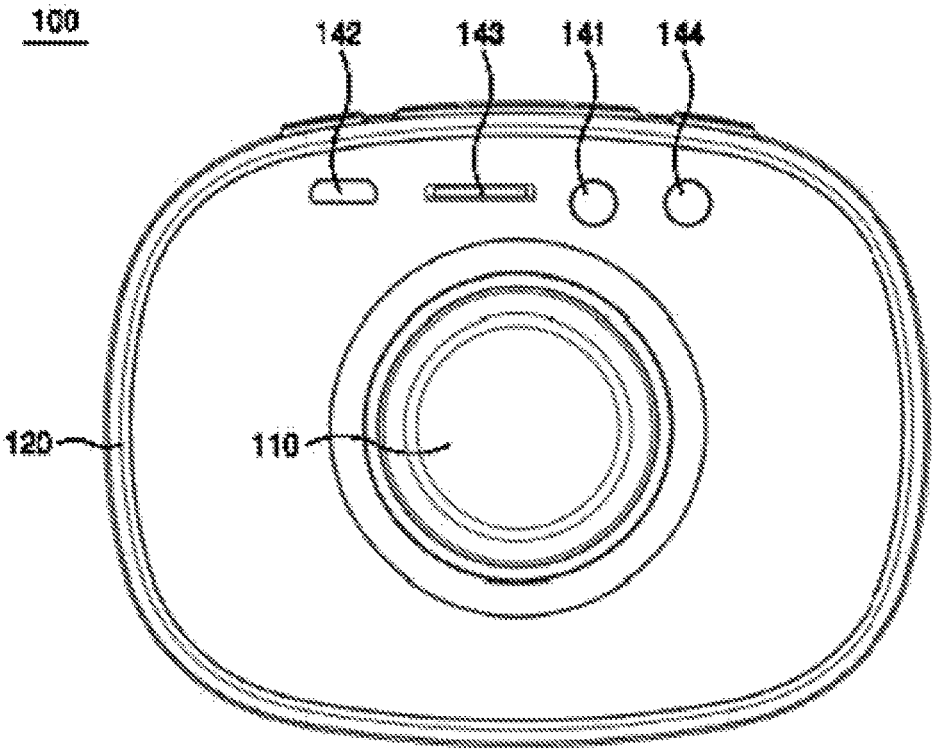
Figure 5:
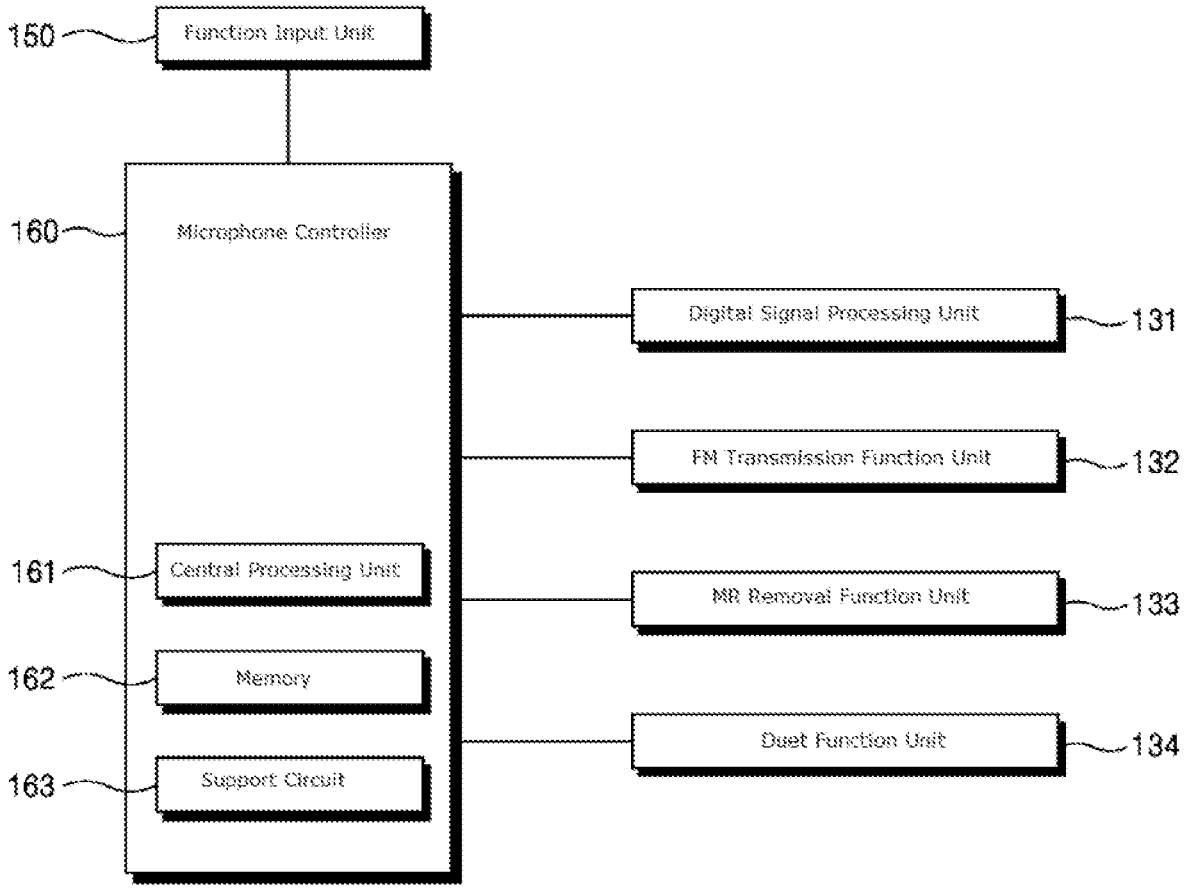
FIG. 5 is a control block diagram showing the multifunctional Bluetooth microphone of FIG. 1.

FIG. 1 is a perspective view showing a multifunctional Bluetooth microphone according to a first embodiment of to the present invention, FIGS. 2 to 4 are a front view, a plan view and a bottom view of FIG. 1, and FIG. 5 is a control block diagram showing the multifunctional Bluetooth microphone of FIG. 1.

Referring to these drawings, since a multifunctional Bluetooth microphone 100 according to the present embodiment may be equipped with various functions such as a digital signal processor (DSP) 131, in addition to conventional simple functions, a user may enjoy singing more cheerfully, and therefore, the Bluetooth microphone may attract interest and curiosity of consumers.

The multifunctional Bluetooth microphone 100 according to the present embodiment capable of providing such an effect may include a handle 110 having a microphone head 112 formed at one end, a device mounting unit 120, a digital signal processing unit 131, a function input unit 150, and a microphone controller 160.

The handle 110 is a part that a user, for example, a user who wants to sing a song, holds with a hand. It may have a cross-sectional area of a suitable size for the sake of stable holding, and the outer surface may be applied with a non-slip material or may be coated with rubber.

The microphone head 112 into which a sound signal is input is provided at an end of the handle 110. The shape of the microphone head 112 may be diverse without limit, more than the shapes shown in the drawings. Therefore, the scope of the present invention is not limited to the shapes in the drawings.

The device mounting unit 120 is provided on one side of the handle 110. The device mounting unit 120 is coupled to the handle 110 to be adjacent to the microphone head 112, and it is equipped with Bluetooth technology, and a high-power speaker 122 is provided on one side.

An FM transmission function unit 132, an MR removal function unit 133, and a duet function unit 134, including the digital signal processing unit 131, may be mounted in the device mounting unit 120 forming a box structure, and the function input unit 150 and the microphone controller 160 are applied to control selection or execution of these modes.

The digital signal processing unit 131 is provided in the device mounting unit 120, and it is a device or a module chip capable of adding an additional function of at least one type of echo mode or at least one type of voice modulation mode to a voice of a person by performing digital signal processing on the voice.

Although it is general that a user's own voice is output as it is, as the digital signal processing unit 131 is mounted in the multifunctional Bluetooth microphone 100 according to the present embodiment, the echo mode or the voice modulation mode may be implemented according to an input condition input through the function input unit 150.

For example, in the case of a general lecture, conference, or meeting other than the karaoke mode, a non-echo mode may be selected, and in the case of singing, a singer-level restrained reverb effect mode, an echo mode suitable for singing, and a karaoke-class powerful echo mode or the like may be executed according to an input condition. All of these modes correspond to the echo mode.

In addition, modulation of a voice to an electronic voice, a female voice, a male voice, or a baby voice is possible, and as a voice may be output in various forms other than his or her own voice, the user may enjoy singing more cheerfully, and therefore, the Bluetooth microphone may attract interest and curiosity of consumers.

The FM transmission function unit 132 is provided in the device mounting unit 120 as a means for wireless expansion.

That is, the FM transmission function unit 132 mixes a sound source transferred through Bluetooth with an input voice of a person, and then outputs the sound through a radio receiver by FM transmission. This operation may also be controlled by the microphone controller 160 according to an input signal of the function input unit 150.

The MR removal function unit 133 performs a function of emphasizing a voice of a person by removing chorus and accompaniment portions (Music Recorded, MR) from the sound source transferred through Bluetooth. The operation of the MR removal function unit 133 may also be controlled by the microphone controller 160 according to an input signal of the function input unit 150.

Meanwhile, the duet function unit 134 is a mode used when it is desired to sing a song as a duet. In this case, two multifunctional Bluetooth microphones 100 are required.

When any one multifunctional Bluetooth microphone 100 is connected to a Bluetooth sound source while at least two multifunctional Bluetooth microphones 100 are connected through Bluetooth, the duet function unit 134 allows the multifunctional Bluetooth microphone 100 to interwork with other multifunctional Bluetooth microphones 100 to simultaneously play back the Bluetooth sound source.

The duet function unit 134 like this may be conveniently used when singing a duet song. The operation may also be controlled by the microphone controller 160 according to an input signal of the function input unit 150.

In addition to the functions described above, an LED display window 121 is provided on one side of the device mounting unit 120. The LED display window 121 performs a function of outputting an input value of the function input unit 150. In addition, the status of a song played back may be displayed through the LED display window 121.

An auxiliary (Aux) out terminal unit 141, a multi-USB port 142, a memory card port 143, and an earphone jack 144 are provided on the bottom of the device mounting unit 120.

The Aux out terminal unit 141 is a port for wired expansion. By connecting a separate line, the multifunctional Bluetooth microphone 100 of the present embodiment may be connected to a wired speaker or device, not wireless ones.

The multi-USB port 142 is a port that enables charging or data communication. Since a high-capacity battery (not shown) is mounted in the handle 110, the multi-USB port 142 may be used to charge the battery and to store sound sources such as songs or the like in the built-in memory of the multi-function Bluetooth microphone 100.

The memory card port 143 is for expanding the memory by inserting an SD card or the like, and the earphone jack 144 is a part for connecting a headphone or an earphone.

Meanwhile, the function input unit 150 is provided in the device mounting unit 120, and it is a means for selecting various modes of the FM transmission function unit 132, the MR removal function unit 133, and the duet function unit 134, including the digital signal processing unit 131. Although the function input unit 150 is applied in the form of a button in the drawing, the function input unit 150 may also be implemented in the form of a touch screen.

The microphone controller 160 performs a function of controlling the operation of the digital signal processing unit 131, the FM transmission function unit 132, the MR removal function unit 133, and the duet function unit 134 on the basis of an input signal of the function input unit 150.

The microphone controller 160 performing this function may include a central processing unit (CPU) 161, a memory 162, and a support circuit 163.

In the present embodiment, the central processing unit 161 may be one of various computer processors that can be industrially applied to control the operation of the digital signal processing unit 131, the FM transmission function unit 132, the MR removal function unit 133, and the duet function unit 134 on the basis of an input signal of the function input unit 150.

The memory 162 is connected to the central processing unit 161. The memory 162 may be locally or remotely installed as a computer-readable recording medium, and for example, it may be at least one or more memory units that can be easily used, such as random access memory (RAM), read only memory (ROM), a floppy disk, a hard disk, or an arbitrary digital storage form.

The support circuit 163 is coupled to the central processing unit 161 and supports typical operations of a processor. The support circuit 163 may include a cache, a power supply, a clock circuit, an input/output circuit, a subsystem, and the like.

In the present embodiment, the microphone controller 160 controls the operation of the digital signal processing unit 131, the FM transmission function unit 132, the MR removal function unit 133, and the duet function unit 134 on the basis of an input signal of the function input unit 150, and a series of control processes like this may be stored in the memory 162. Typically, software routines may be stored in the memory 162. The software routines may also be stored or executed by other central processing units (not shown).

Although the process according to the present invention has been described as being executed by a software routine, at least some of the processes of the present invention may also be performed by hardware. Like this, the processes of the present invention may be implemented as software executed on a computer system, hardware such as an integrated circuit, or a combination of software and hardware.

According to the present embodiment operating on the basis of the structure as described above, as various functions such as a digital signal processor (DSP) 131 may be mounted in addition to conventional simple functions, a user may enjoy singing more cheerfully, and therefore, the Bluetooth microphone may attract interest and curiosity of consumers.

Figure 6:
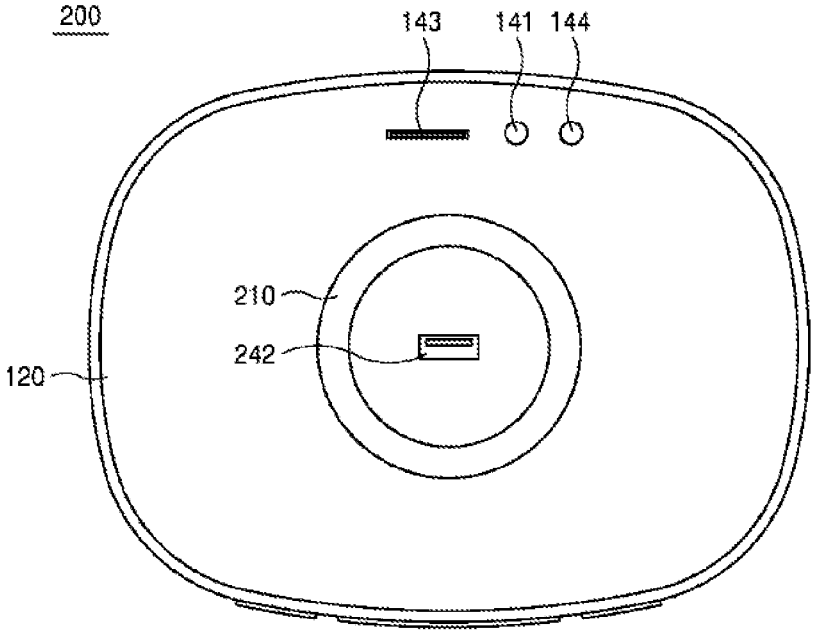
FIG. 6 is a bottom view showing a multifunctional Bluetooth microphone according to a second embodiment of to the present invention.
Figure 7:
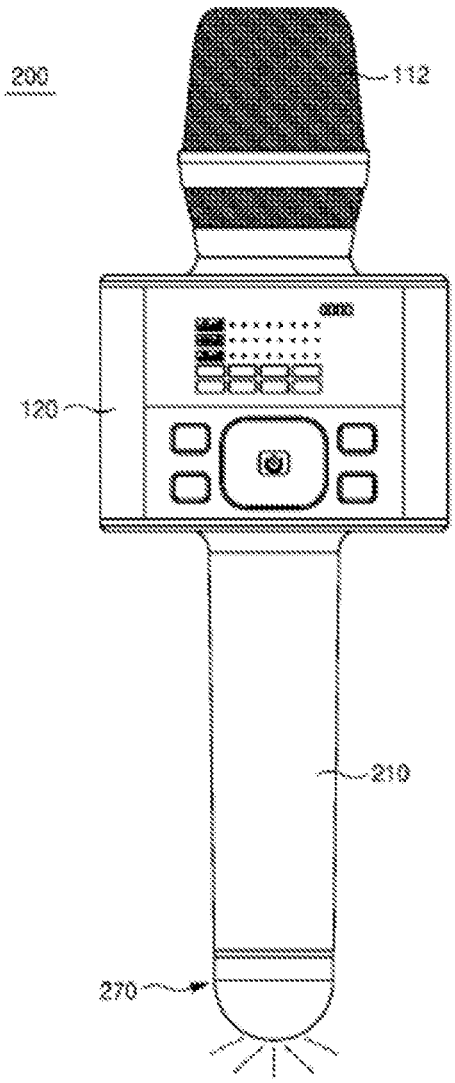
FIG. 7 is a view showing a state combining a USB light emitting lamp with the multifunctional Bluetooth microphone of FIG. 6.
Figure 8:
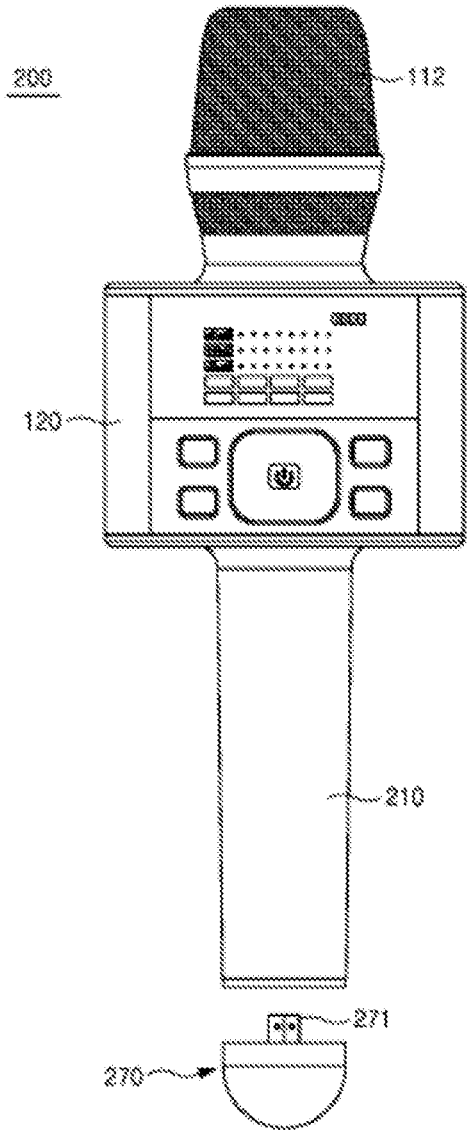
FIG. 8 is an exploded view of FIG. 7.

FIG. 6 is a bottom view showing a multifunctional Bluetooth microphone according to a second embodiment of to the present invention, FIG. 7 is a view showing a state combining a USB light emitting lamp with the multifunctional Bluetooth microphone of FIG. 6, and FIG. 8 is an exploded view of FIG. 7.

Referring to these drawings, a multifunctional Bluetooth microphone 200 according to the present embodiment also includes a handle 210 having a microphone head 112 formed at one end, and a device mounting unit 120 equipped with a digital signal processing unit 131, an FM transmission function unit 132, an MR removal function unit 133, a duet function unit 134, and the like.

A multi-USB port 242 for charging or communication is also formed in the multi-function Bluetooth microphone 200 according to the present embodiment, and the multi-USB port 242 is disposed at the center on the bottom of the handle 210.

At this point, an additional USB light emitting lamp 270 may be connected to the multi-USB port 242 and used. The USB light emitting lamp 270 includes a terminal coupling unit 271 detachably coupled to the multi-USB port 242, and it is a lamp that emits light when music is output.

Meanwhile, in the present embodiment, the microphone controller 160 (see FIG. 5) controls the operation of the USB light emitting lamp 270 to be automatically turned on when the USB light emitting lamp 270 is connected.

In other words, as music is output and the USB light emitting lamp 270 automatically operates at the same time only by inserting the USB light emitting lamp 270 without operating a separate button or switch, convenience of use may be increased.

Figure 9:
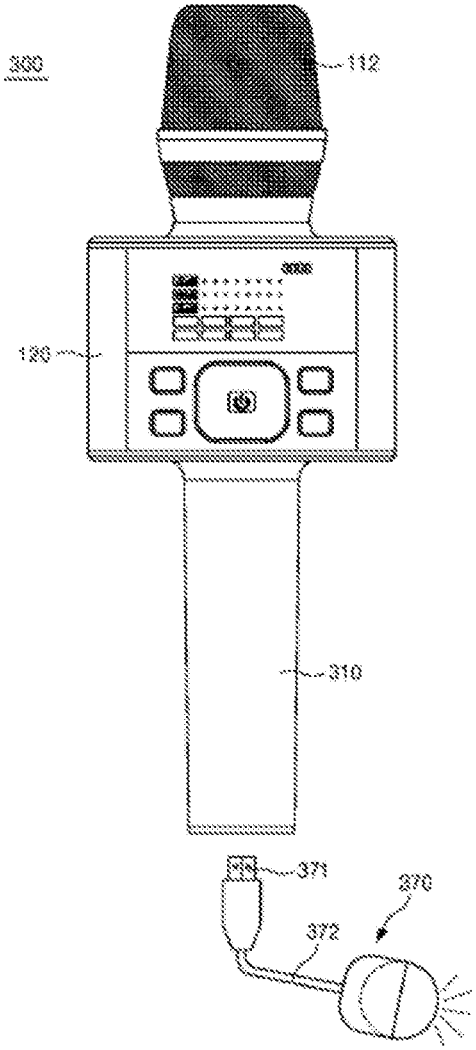
FIG. 9 is a view showing the structure of a multifunctional Bluetooth microphone having a USB light emitting rotation ball according to a third embodiment of the present invention.

FIG. 9 is a view showing the structure of a multifunctional Bluetooth microphone having a USB light emitting rotation ball according to a third embodiment of the present invention.

Referring to this drawing, a multifunctional Bluetooth microphone 300 according to the present embodiment also includes a handle 310 having a microphone head 112 formed at one end, and a device mounting unit 120 equipped with a digital signal processing unit 131, an FM transmission function unit 132, an MR removal function unit 133, a duet function unit 134, and the like.

A multi-USB port (not shown) for charging or communication is also formed in the multi-function Bluetooth microphone 300 according to the present embodiment. Although the multi-USB port may be disposed at the center on the bottom of the handle 310, it may be placed at a different position without a problem.

In this structure, an additional USB light emitting rotation ball 370 may be connected to the multi-USB port and used.

The USB light emitting rotation ball 370 may include a terminal coupling unit 371 detachably coupled to the multi-USB port, a rotating lamp ball 373 for emitting light while rotating, and a connection line 372 for connecting the terminal coupling unit 371 and the rotating lamp ball 373.

Meanwhile, in the present embodiment, the microphone controller 160 (see FIG. 5) controls the operation of the USB light emitting rotation ball 370 to be automatically turned on when the USB light emitting rotation ball 370 is connected.

In other words, as music is output and the USB light emitting rotation ball 370 automatically operates at the same time only by inserting the USB light emitting rotation ball 370 without operating a separate button or switch, convenience of use may be increased.

Figure 10:
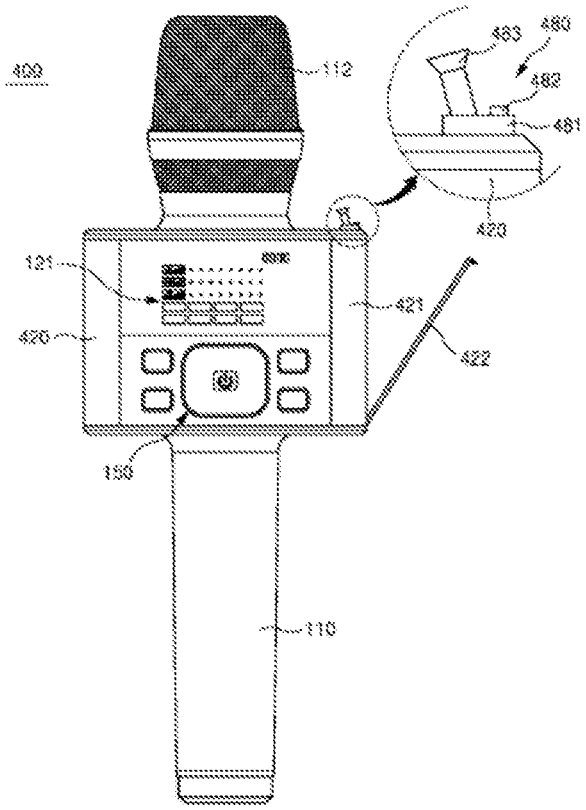
FIG. 10 is a front view showing a multifunctional Bluetooth microphone according to a fourth embodiment of the present invention.

FIG. 10 is a front view showing a multifunctional Bluetooth microphone according to a fourth embodiment of the present invention.

Referring to this drawing, a multifunctional Bluetooth microphone 400 according to the present embodiment also includes a handle 110 having a microphone head 112 formed at one end, and a device mounting unit 420 equipped with a digital signal processing unit 131, an FM transmission function unit 132, an MR removal function unit 133, a duet function unit 134, and the like.

Meanwhile, the multifunctional Bluetooth microphone 400 of the present embodiment is further provided with a disinfection spray unit 480 for killing viruses.

The disinfection spray unit 480 may include a container body (not shown) containing a predetermined disinfectant for killing viruses or sterilization, a container head 481 connected to the container body and exposed toward the top of the device mounting unit 420, a spray nozzle 483 provided in the container head 481 to spray disinfectant solution toward the microphone head 112, and a button 482 for spraying the disinfectant solution toward the container head 481 through the spray nozzle 483.

At this point, the container body may be installed to be replaceable in a container accommodation box 421 formed on one side of the device mounting unit 420. At this point, the container accommodation box 421 may be opened and closed using a rotating cover 422.

When the disinfection spray unit 480 is applied to the multifunctional Bluetooth microphone 400 as described above, it is expected that the multifunctional Bluetooth microphone 400 can be used in a healthy way without a problem related to recent virus transmission. That is, since a user may sing a song using the multifunctional Bluetooth microphone 400 after spraying the disinfectant solution toward the container head 481 through the spray nozzle 483 by pressing the button 482, the product can be used safely.

According to the present invention, since various functions such as a digital signal processor (DSP) can be mounted, in addition to conventional simple functions, there is an effect of allowing a user to enjoy singing more cheerfully and attracting interest and curiosity of consumers.

As described above, the present invention is not limited to the disclosed embodiments, and it is obvious to those skilled in the art that various changes and modifications can be made without departing from the spirit and scope of the present invention. Therefore, it should be construed that such changes or modifications belong to the claims of the present invention.

What is claimed is:

1. A multifunctional Bluetooth microphone comprising:

a handle having a microphone head formed at one end to receive a sound signal;

a device mounting unit coupled to the handle to be adjacent to the microphone head, equipped with Bluetooth technology, and provided with a speaker on one side;

a digital signal processing unit provided in the device mounting unit to add an additional function of at least one echo mode or at least one voice modulation mode to a voice of a person by performing digital signal processing on the voice;

a function input unit provided in the device mounting unit for operation of the digital signal processing unit;

a microphone controller for controlling operation of the digital signal processing unit on the basis of an input signal of the function input unit;

an FM transmission function unit provided in the device mounting unit to mix a sound source transferred through Bluetooth with an input voice of the person for wireless expansion and then output the sound through a radio receiver by FM transmission, wherein an operation thereof is controlled by the microphone controller according to the input signal of the function input unit;

an MR removal function unit for emphasizing the voice of the person by removing chorus and accompaniment portions (MR) from the sound source transferred through Bluetooth, wherein an operation thereof is controlled by the microphone controller according to the input signal of the function input unit; and a duet function unit for allowing, when any one multifunctional Bluetooth microphone is connected to a Bluetooth sound source in a state where two or more multifunctional Bluetooth microphones are connected through Bluetooth, all the multifunctional Bluetooth microphones to interwork and simultaneously play back the Bluetooth sound source, wherein an operation thereof is controlled by the microphone controller according to the input signal of the function input unit.

2. The microphone according to claim 1, further comprising:

an LED display window provided on one side of the device mounting unit to output an input value of the function input unit;

an auxiliary (Aux) out terminal unit provided on a bottom of the device mounting unit for wired expansion;

a multi-USB port disposed around the Aux out terminal unit and capable of charging or data communication;

a memory card port provided on one side of the device mounting unit; and an earphone jack provided on one side of the device mounting unit.

3. The microphone according to claim 1, further comprising a USB light emitting lamp including a terminal coupling unit detachably coupled to the multi-USB port and emitting light when music is output, wherein the microphone controller controls an operation of the USB light emitting lamp to be automatically turned on when the USB light emitting lamp is connected.

4. The microphone according to claim 1, further comprising a USB light emitting rotation ball including a terminal coupling unit detachably coupled to the multi-USB port, a rotating lamp ball for emitting light while rotating, and a connection line for connecting the terminal coupling unit and the rotating lamp ball, and emitting light and rotating when music is output, wherein when the USB light emitting rotation ball is connected, the microphone controller controls an operation of the USB light emitting rotation ball to be automatically turned on.

* * * * *